United States Patent [19]

Johnson

[11] 4,352,534

[45] Oct. 5, 1982

[54] BUS BAR

[75] Inventor: Lennart B. Johnson, Milford, N.H.

[73] Assignee: Teradyne, Inc., Boston, Mass.

[21] Appl. No.: 156,808

[22] Filed: Jun. 5, 1980

[51] Int. Cl.[3] ..... H01R 31/08

[52] U.S. Cl. ..... 339/19; 339/22 B; 339/278 C

[58] Field of Search ..... 339/19, 22 B, 222, 278 C

[56] References Cited

U.S. PATENT DOCUMENTS

| | | | |
|---|---|---|---|
| 1,904,241 | 4/1933 | Kammerer | 339/278 C X |
| 3,525,066 | 8/1970 | Magee et al. | 339/278 C X |
| 3,582,864 | 6/1971 | Sullivan | 339/19 |
| 3,829,818 | 8/1974 | Iosue et al. | 339/19 |
| 3,918,788 | 11/1975 | Walter et al. | 339/19 |
| 3,951,497 | 4/1976 | Balzano et al. | 339/19 |
| 4,033,657 | 7/1977 | Kemper | 339/19 |

*Primary Examiner*—Joseph H. McGlynn
*Assistant Examiner*—Frank H. McKenzie, Jr.

[57] ABSTRACT

A bus bar constructed to bend connector posts and make electrical contact with them at three loci of bar points. In vertical section, vertical lines between first and second bus contact points are spaced from third bus contact points adjacent said vertical lines by a distance less than the thickness of the posts, the locus defined by said vertical lines corresponding generally with a locus of post centerlines.

8 Claims, 3 Drawing Figures

BUS BAR

FIELD OF THE INVENTION

This invention relates to bus bars used to interconnect pluralities of connector posts.

BACKGROUND OF THE INVENTION

A number of bus devices have been used in the past to interconnect a row of connector posts. For example, Balzano et al. U.S. Pat. No. 3,951,497 discloses a springy bus bar having holes through it, for insertion of the posts, and resilient members to grip the posts.

SUMMARY OF THE INVENTION

It has been discovered that conductivity can be improved in a bus bar by having the bus bar constructed to bend the posts and make electrical contact at three loci of bar points, the bending being caused by having in vertical section, vertical lines between first and second bus contact points spaced from third bus contact points adjacent said vertical lines by a distance less than the thickness of the posts, the locus defined by said vertical lines corresponding generally with a locus of post centerlines.

In preferred embodiments, the bus has a J-shaped cross-section, the longer side carrying the first and second contact points near its ends, the shorter side carrying the third contact points near its end; the end adjacent the first contact points is turned out in a first direction, and the end adjacent the third contact points is turned out in the opposite direction; the bar is made of copper; the bar is plated with either tin or gold over nickel; and a dielectric tape covers the exterior surfaces of the bar.

DESCRIPTION OF THE PREFERRED EMBODIMENT

The structure and use of the presently preferred embodiment will be described after first briefly describing the drawings.

Drawings

STRUCTURE

Figure 1:
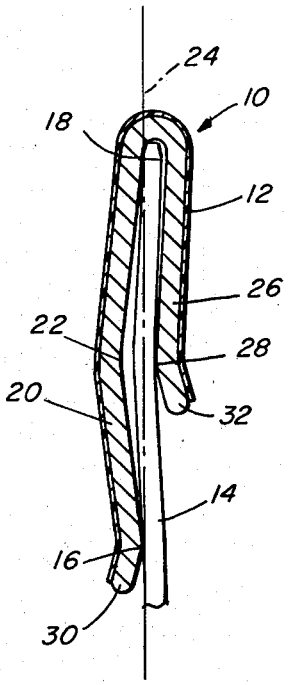
FIG. 1 is a vertical sectional view of a bus bar made according to the invention and clipped on to a connector post.

Referring to FIG. 1, J-shaped bus bar 10 (copper base material selectively plated with gold over nickel and covered with dielectric tape 12) is shown clipped onto connector post 14 (0.025"×0.025" and made of springy material, e.g., BeCu or phosphor/bronze). Bar 10 has, in vertical section, first contact points 16 and second contact points 18, which are on the interior surface of long member 20. Intermediate portion 22 of member 20 is spaced transversely from line 24 passing through points 16 and 18. Short member 26 has, in vertical section, third contact points 28, which are spaced transversely from line 24 by a distance less than the thickness of post 14. First member 20 has turned-out end 30 adjacent points 16, and short member 26 has turned-out end 32 adjacent third contact 28.

Figure 2:
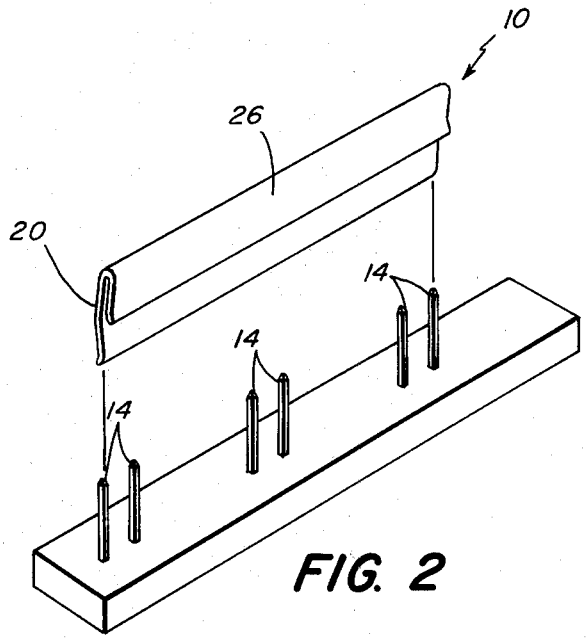
FIG. 2 is a perspective view of said bar shown aligned with a row of connector posts prior to connection.

Referring to FIG. 2, connector posts 14 have a square cross-section, and two sets of post faces are parallel to a plane passing through the posts.

Use

Figure 3:
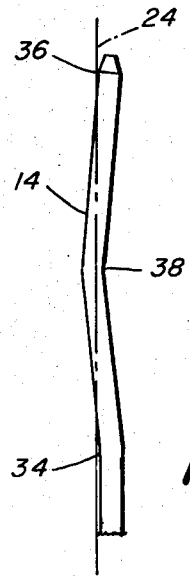
FIG. 3 is a diagrammatic vertical elevation of a connector post.

Referring to FIGS. 1 and 2, the bar is easily clipped on or off in use. Because of the spacing of the three contact loci and the springiness of post 14, posts 14 bend when bar 10 is clipped on, and this provides the normal force required for electrical contact. (The bend caused in post 14 is shown exaggerated in FIG. 3.) Bar contact points 16, 18, 28 contact a post at 34, 36, 38, respectively. Ends 30, 32 are turned out to facilitate assembly.

Because bar 10 need not be resilient, it can be made of thick, soft copper having improved conductivity over springy material (e.g. BeCu or phosphor/bronze, which have 26% and 15% conductivity, respectively, compared to copper). Also bar 10 has no holes or notches, which reduce current carrying capability.

Other Embodiments

Other bar geometries can be used to result in the three contact loci construction of bus bar 10. Also, the copper base material can be plated with tin over nickel instead of gold over nickel.

What is claimed is:

1. In an easily attachable bus bar to interconnect a number of connector posts, the center lines of said posts defining a post locus, the improvement comprising:

a first portion having, in vertical section, first and second contact points, said first portion having an intermediate portion between said first and second points spaced in a first direction transversely to vertical lines connecting said first and second points, and a second portion integrally connected to said first portion and spaced from said first portion in a second direction opposite to said first direction, said second portion having, in vertical section, third contact points adjacent to said intermediate portion and spaced in said second direction from said vertical lines by a distance less than the thickness of said posts, said first, second, and third contact points defining a post-insertion region between them, said bar being constructed to bend said posts when said bar is attached to them to provide the normal force for electrical contact, the locus defined by said vertical lines corresponding generally to said post locus.

2. The bar of claim 1 wherein said bar has a J-shaped cross-section, said first portion being the longer side, said second portion being the shorter side, said contact points being located on interior surfaces.

3. The bar of claim 2 wherein the end adjacent said first point is bent in said first direction, and the end adjacent said third point is bent in said second direction.

4. The bar of claim 1 wherein said bar is made of copper.

5. The bar of claim 4 wherein said copper is plated with material selected from the group consisting of tin over nickel and gold over nickel.

6. The bar of claim 5 wherein dielectric tape covers the exterior surface of said bar.

7. The bar of claim 1 wherein said first and second portions extend along a longitudinal axis passing transversely through said vertical lines and are substantially the same, in vertical section, along said axis.

8. The bar of claim 1 or 2 wherein said first and second portions extend along a longitudinal axis passing transversely through said vertical lines and are substantially the same, in vertical section, along said axis, and wherein said first and second portions are continuously connected to each other along said axis so that the tops of said posts do not extend through said bar.

* * * * *